US008727026B2

(12) United States Patent
Caldwell et al.

(10) Patent No.: US 8,727,026 B2
(45) Date of Patent: May 20, 2014

(54) DUAL ISOLATION MECHANISM OF CEMENTATION PORT

(75) Inventors: Rebecca M. Caldwell, Houston, TX (US); Christopher J. Cuffe, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 282 days.

(21) Appl. No.: 12/651,210

(22) Filed: Dec. 31, 2009

(65) Prior Publication Data

US 2010/0163253 A1 Jul. 1, 2010

Related U.S. Application Data

(60) Provisional application No. 61/141,888, filed on Dec. 31, 2008.

(51) Int. Cl.
*E21B 34/14* (2006.01)

(52) U.S. Cl.
USPC ..... 166/387; 166/289; 166/332.4

(58) Field of Classification Search
CPC ..... E21B 34/14; E21B 33/146; E21B 33/16; E21B 2034/007; E21B 34/103
USPC ..... 166/387, 191, 289, 332.4, 334.1, 334.4, 166/332.1
See application file for complete search history.

(56) References Cited

U.S. PATENT DOCUMENTS 2,659,438 A * 11/1953 Schnitter ..... 166/154
2,928,470 A * 3/1960 Baker ..... 166/154
3,151,681 A * 10/1964 Cochran ..... 166/332.4
3,378,068 A * 4/1968 Page, Jr. ..... 166/373
3,464,493 A 9/1969 Chancellor et al.
3,768,556 A * 10/1973 Baker ..... 166/154
3,789,926 A * 2/1974 Henley et al. ..... 166/318
3,811,500 A * 5/1974 Morrisett et al. ..... 166/154
3,827,491 A * 8/1974 Dinning ..... 166/154
3,948,322 A * 4/1976 Baker ..... 166/289
4,260,017 A * 4/1981 Nelson et al. ..... 166/154
4,280,561 A * 7/1981 Fredd ..... 166/332.4
4,429,747 A * 2/1984 Williamson, Jr. ..... 166/321
4,669,541 A * 6/1987 Bissonnette ..... 166/154
4,771,831 A * 9/1988 Pringle et al. ..... 166/319
4,858,692 A * 8/1989 Nilsen ..... 166/285
4,928,772 A * 5/1990 Hopmann ..... 166/386
5,024,273 A * 6/1991 Coone et al. ..... 166/289
5,109,925 A * 5/1992 Stepp et al. ..... 166/184
5,289,875 A * 3/1994 Stokley et al. ..... 166/264
5,314,015 A 5/1994 Streich et al.
5,368,098 A * 11/1994 Blizzard et al. ..... 166/100

(Continued)

OTHER PUBLICATIONS

Dictionary definition of "engage", accessed on May 11, 2012 via thefreedictionary.com.*

(Continued)

*Primary Examiner* — Blake Michener
(74) *Attorney, Agent, or Firm* — Patterson & Sheridan, L.L.P.

(57) ABSTRACT

An apparatus for providing fluid communication includes a housing having a port; an inner sleeve adapted to seal the port; and a seal sleeve adapted to seal the port, wherein the seal sleeve is disposed between the inner sleeve and the housing and is movable with the inner sleeve to seal the port. In another embodiment, the port is sealed using a metal to metal seal.

41 Claims, 12 Drawing Sheets

(56) References Cited

U.S. PATENT DOCUMENTS

| | | | | |
|---|---|---|---|---|
| 5,411,095 | A * | 5/1995 | Ehlinger et al. | 166/317 |
| 5,464,062 | A * | 11/1995 | Blizzard, Jr. | 166/376 |
| 5,711,372 | A | 1/1998 | Stokley | |
| 5,957,208 | A * | 9/1999 | Schnatzmeyer | 166/373 |
| 6,098,710 | A * | 8/2000 | Rhein-Knudsen et al. | 166/285 |
| 6,267,181 | B1 * | 7/2001 | Rhein-Knudsen et al. | 166/332.4 |
| 6,422,317 | B1 * | 7/2002 | Williamson, Jr. | 166/374 |
| 6,817,416 | B2 | 11/2004 | Wilson et al. | |
| 7,284,619 | B2 | 10/2007 | Stokley et al. | |
| 2003/0019630 | A1 * | 1/2003 | Freiheit et al. | 166/332.4 |
| 2005/0139355 | A1 * | 6/2005 | Coronado et al. | 166/278 |
| 2006/0124310 | A1 * | 6/2006 | Lopez de Cardenas et al. | 166/313 |
| 2009/0095463 | A1 * | 4/2009 | Swan et al. | 166/53 |
| 2009/0095486 | A1 * | 4/2009 | Williamson, Jr. | 166/373 |
| 2010/0206572 | A1 * | 8/2010 | Makowiecki et al. | 166/332.1 |

OTHER PUBLICATIONS

Dictionary definitions of "across" and "attached", accessed Oct. 15, 2013 via thefreedictionary.com.*

Canadian Office Action for Application No. 2,689,480 dated May 4, 2011.

* cited by examiner

DUAL ISOLATION MECHANISM OF CEMENTATION PORT

CROSS-REFERENCE TO RELATED APPLICATIONS

This application claims benefit of U.S. Provisional Patent Application No. 61/141,888, filed Dec. 31, 2008, which application is incorporated herein by reference in its entirety.

BACKGROUND OF THE INVENTION

1. Field of the Invention

The present invention relates to a downhole tool having a port for fluid communication through a tubular string and operations of the downhole tool. More particularly, the present invention relates to a ported tool having a non-elastomeric seal mechanism and operation thereof. More particularly still, the present invention relates to a ported stage tool suitable for cementation applications.

2. Description of the Related Art

Cementing a well protects possible production zones behind the casing against salt water flow and protects the casing against corrosion from subsurface mineral waters and electrolysis from outside. Cementing also eliminates the danger of fresh drinking water and recreational water supply strata from being contaminated by oil or salt water flow through the borehole from formations containing these substances. It further prevents oil well blowouts and fires caused by high pressure gas zones behind the casing and prevents collapse of the casing from high external pressures which can build up under ground.

A cementing operation for protection against the above described downhole conditions is accomplished by flowing the cement slurry down the casing and back up the outside of the casing in the annulus between the casing and the borehole wall. As wells are drilled deeper and deeper, it has become more difficult to successfully cement the entire well from the bottom of the casing. Multiple stage cementing has been developed to allow the annulus to be cemented in separate stages, beginning at the bottom of the well and working upwardly.

Multiple stage cementing is achieved by placing cementing tools, which are primarily valved ports, in the casing or between joints of casing at one or more locations in the borehole. The cement is flowed through the bottom of the casing and up the annulus to the lowest cementing tool in the well. The bottom is then closed off and the cementing tool is opened to expose the port. Thereafter, cement is flowed through the cement tool up the annulus to the next upper stage. The process is repeated until all of the stages of cementing have been completed.

Generally, the ports of the cementing tools are sealed using an elastomeric seal. However, in some instances where gas flow is encountered, the elastomeric seal may fail, thereby allowing gas to flow and communicate between the annulus and the interior of the casing.

There is a need, therefore, for an improved sealing mechanism for a cementing tool. There is also a need for a ported tool having a non-elastomeric seal mechanism.

SUMMARY OF THE INVENTION

Embodiments of the present invention provide a downhole tool having a port for fluid communication through a tubular string and a sealing mechanism for operations of the port. In one embodiment, the present invention provides a ported tool having a non-elastomeric sealing member and operation thereof. In another embodiment, the present invention provides a ported stage tool suitable for downhole applications such as cementation.

In one embodiment, an apparatus for providing fluid communication includes a housing having a port; an inner sleeve adapted to seal the port; and a seal sleeve adapted to seal the port, wherein the seal sleeve is disposed between the inner sleeve and the housing and is movable with the inner sleeve to seal the port. In another embodiment, the port is sealed using a metal to metal seal.

In another embodiment, a method of controlling fluid communication through a port of a ported tool includes providing one or more sealing members on each side of the port; moving an inner sleeve to open the port; supplying fluid through the port; engaging the inner sleeve to a seal sleeve; and moving the seal sleeve to engage the one or more sealing members on each side of the port, thereby closing off the port.

A method of cementing a wellbore includes positioning a casing string in the wellbore, wherein the casing string includes a ported tool having a port; supplying cement through the bottom of the casing string; opening the port by moving an inner sleeve; supplying more cement through the port; and moving the inner sleeve and a seal sleeve across the port to close the port.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide a downhole tool having a port for fluid communication through a tubular string and a sealing mechanism for operations of the port. In one embodiment, the present invention provides a ported tool having a non-elastomeric seal mechanism and operation thereof. In another embodiment, the present invention provides a ported stage tool suitable for downhole applications such as cementation or other applications requiring fluid communication through a wall of a tubular string.

Figure 1A:
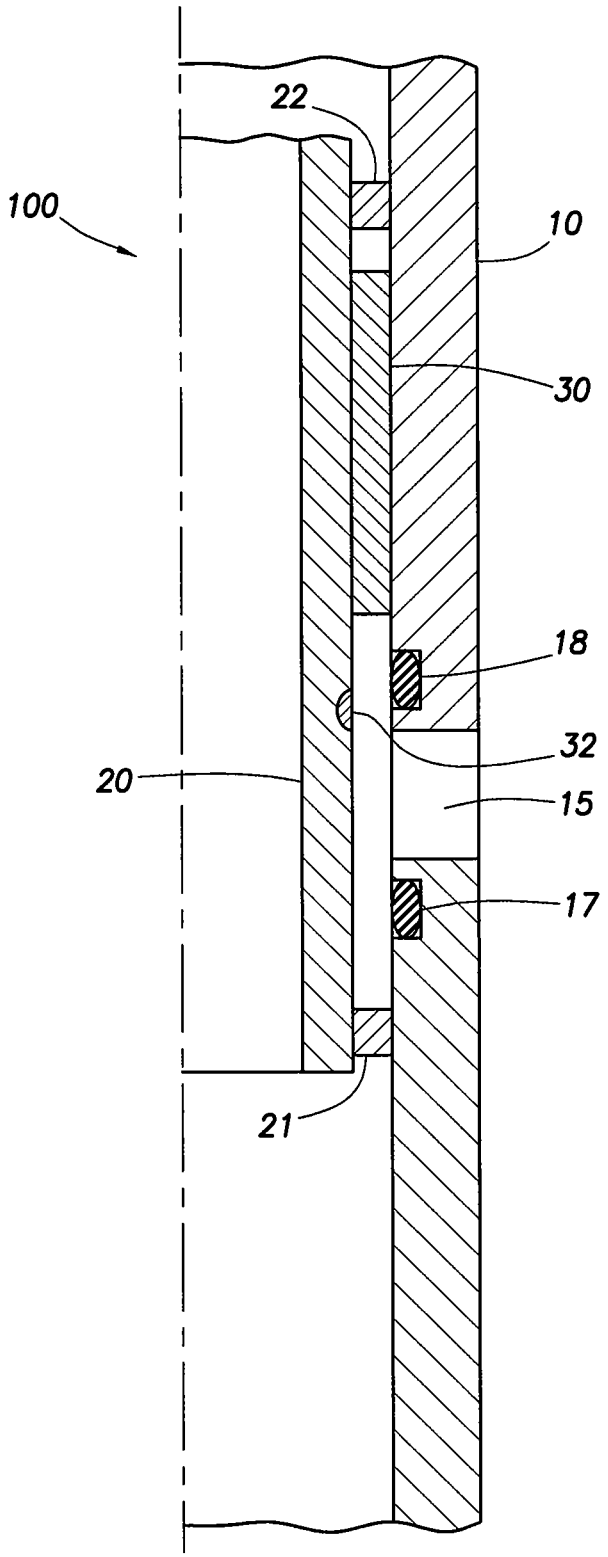
FIGS. 1A-1C show an operation sequence of an embodiment of a ported tool.

FIG. 1A shows a partial cross-sectional view of an exemplary ported tool 100 in a run-in position. The ported tool 100 may include threads at its ends for connection to one or more sections of a tubular string. The ported tool 100 has a housing 10 having a port 15 for fluid communication between an interior of the tool 100 and the exterior of the tool 100, for example, an annulus. Sealing members 17, 18 are positioned on each side of the port 15 and the interior surface of the housing 10. In one embodiment, the sealing members 17, 18 are made of a non-elastomeric material such as metal. An inner sleeve 20 positioned inside the housing 10 is used to initially close the port 15. The inner sleeve 20 has sealing members 21, 22 straddling each side of the port 15. The inner sleeve 20 is axially movable to open the port 15 for fluid communication.

A seal sleeve 30 is positioned between the housing 10 and the inner sleeve 20. During run in, the seal sleeve 30 is disposed on one side of the port 15. The seal sleeve 30 may be made of metal and has sufficient length to extend across the port 15 and contact the sealing members 17, 18 of the housing 10. A connection device 32 such as a snap ring may be provided to connect the seal sleeve 30 to the inner sleeve 20. It is contemplated that the sealing members 17, 18, 21, 22 on the housing 10 or the inner sleeve 20 may be made from any suitable material such as an elastomeric material or non-elastomeric material such as metal or Teflon®. Also, each sealing member may be made from a different material than another sealing member.

Figure 1B:
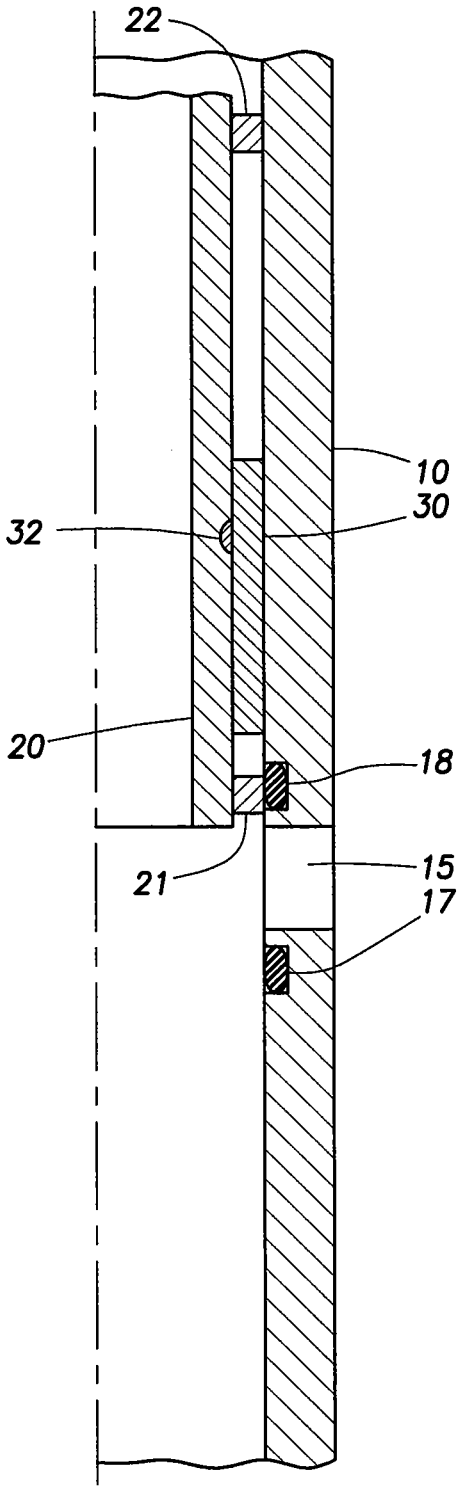
Figure 1C:
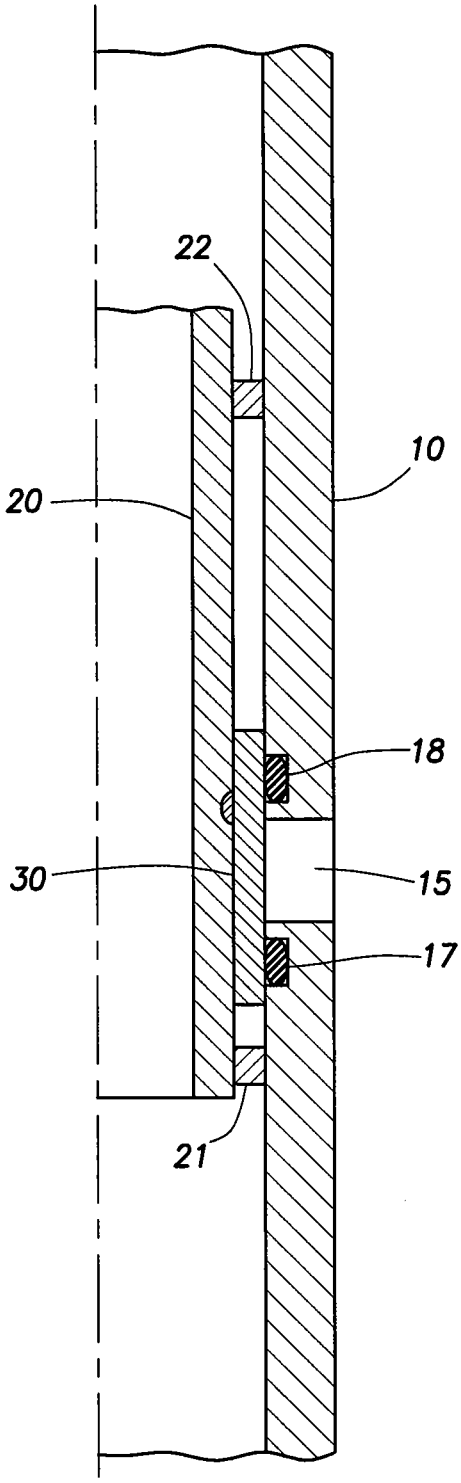

In operation, the ported tool 100 is run-in in the position shown in FIG. 1A. The ported tool 100 is initially closed by the inner sleeve 20, wherein the sealing members 21, 22 of the inner sleeve 20 are positioned on each side of the port 15. To open the port 15, an actuation tool may be used to move the inner sleeve 20 axially relative to the port 15. As shown in FIG. 1B, the inner sleeve 20 is moved upward such that the lower sealing member 21 is moved across the port 15, thereby opening the port for fluid communication. Movement of the inner sleeve 20 may activate the snap ring 32 to connect the inner sleeve 20 to the seal sleeve 30, such that the seal sleeve 30 is movable with the inner sleeve 20. To close the port 15, the inner sleeve 20 and the seal sleeve 30 are moved across the port 15 until the seal sleeve 30 engages the metal sealing members 17, 18 on each side of the port 15, as shown in FIG. 1C. In this respect, a metal to metal seal may be formed between the metal sealing members 17, 18 in the housing 10 and the seal sleeve 30.

Figure 2:
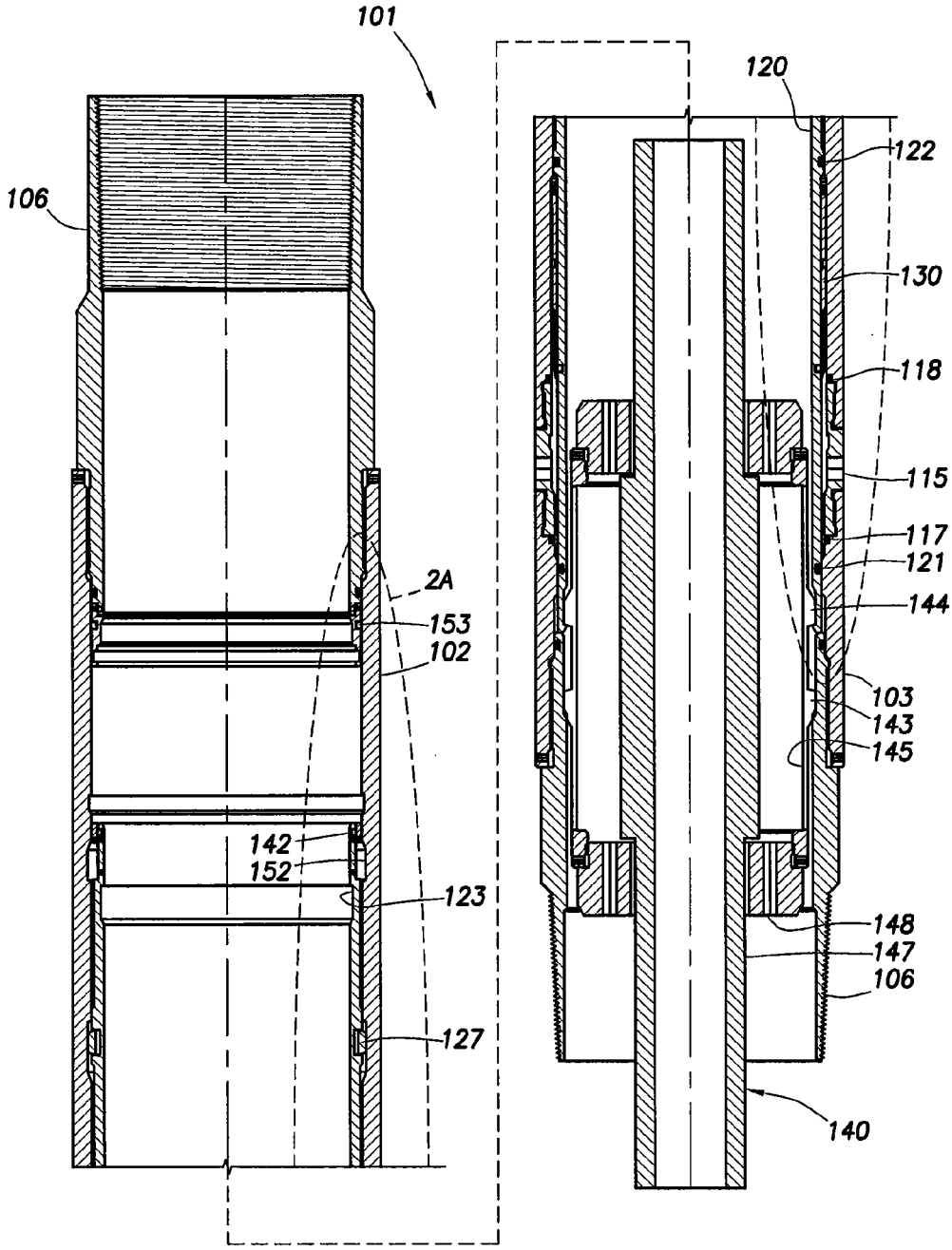
FIG. 2 is a cross-sectional view of another embodiment of a ported tool in the run-in position.
Figure 2A:
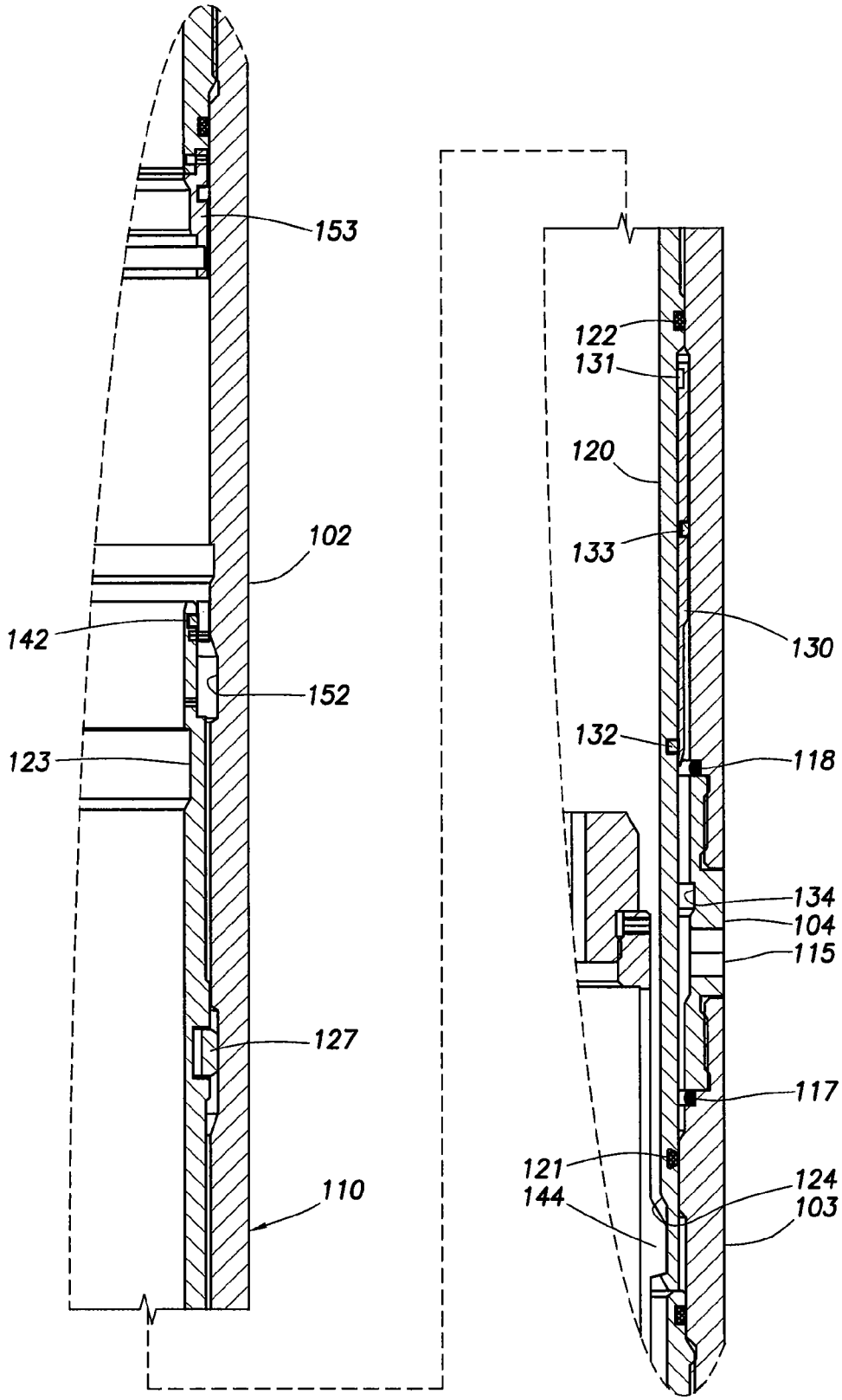
FIG. 2A is an enlarged partial view of FIG. 2.

FIG. 2 shows another embodiment of a ported tool 101. FIG. 2A shows a partial view of the ported tool 101. The ported tool 101 may be connected to a tubular string. In one embodiment, the ported tool 101 is connected to a casing string and used in cementing operations. The ported tool 101 includes a housing 110 and a port 115 for fluid communication between an interior of the tool 101 and the exterior of the tool 101, such as the annulus. In one embodiment, the housing 110 includes an upper portion 102, a lower portion 103, and tubular portion 104 containing the port 115. The ported tool 101 also includes threaded connections 106 for connection to the tubular string.

A sealing member 117, 118 is disposed on each side of the port 115. In one embodiment, the sealing members 117, 118 have a non-elastomeric sealing surface. Exemplary non-elastomeric sealing surfaces include metallic material such as stainless steel, silver, or alloy; or a non-metallic material such as polytetrafluoroethylene (e.g., Teflon®), polyetheretherketone, Nylatron®, or graphite packing. Exemplary sealing members may have a metal or non-metal core, a metal or non-metal plated or coated surface, or combinations thereof. In another embodiment, the sealing members may be a metal arcuate shaped sealing member (e.g., metal ring sealing member or elliptical shaped ring). In yet another embodiment, the sealing members 117, 118 may have a c-shaped metal outer surface that is energized by an elastomeric core. In yet another embodiment still, the sealing members may be a quad ring, which may provide a seal in two directions. Each sealing member 117, 118 may be a seal assembly formed using a plurality of sealing members, for example, two c-shaped metal sealing member positioned adjacent each other or a chevron type sealing member. In yet another embodiment, the sealing member may have a ridge surface having one or more crests and/or made from a softer material than the seal sleeve such that the sealing member may energize, such as by deformation upon contact, to form the seal. In one embodiment, each sealing member 117, 118 is positioned in the housing 110 such that it also seals an interface between the tubular portion 104 and the lower or upper portion 102, 103 of the housing 110.

An inner sleeve 120 is disposed inside the housing 110. The inner sleeve includes a sealing member 121, 122 on each side of the port 115 in contact with the housing 110. The inner sleeve 120 is axially movable relative to the housing 110. During run-in, the inner sleeve 120 is held in position relative to the housing 110 by a stop member 127, such as a détente ring, adapted to engage a recess 151, 152 in the housing 110. The interior surface of the inner sleeve 120 includes an upper profile 123 and a lower profile 124 for engagement with an actuation tool 140. The actuation tool 140 may be operated to axially move the inner sleeve 120. In one embodiment, the actuation tool 140 may have mating profiles 143, 144 on the outer surface of a sleeve body 145 for engaging the respective profiles 123, 124 on the inner sleeve 120. Each mating profile 143, 144 is adapted to move the inner sleeve 120 in a particular direction. For example, the mating profile 144 may engage the lower profile 124 to move inner sleeve 120 downward, while the mating profile 143 may engage the upper profile 123 to move the inner sleeve 120 upward. The mating profiles 143, 144 may have a larger outer diameter than the sleeve body 145, which is biased outward. The sleeve body 145 may be concentrically disposed on a connection sub 147, which may be connected to a run-in string such as drill pipe. One or more flow ports 148 may be provided on the ends of the actuation tool 140 to allow fluid communication above and below the actuation tool 140. In another embodiment, the actuation tool may utilize a J-type connection for engaging the inner sleeve 120. In this respect, the actuation tool may be rotated relative to the inner sleeve in order to connect the actuation tool to the inner sleeve 120. After connection, the actuation tool may be moved axially to move the inner sleeve 120 relative to the port 115.

A seal sleeve 130 is disposed between the inner sleeve 120 and the housing 110. During run-in, the seal sleeve 130 is disposed on one side of the port 115. The seal sleeve 130 may be held in place using a shearable member until the port 115 is ready to be closed. The seal sleeve 130 may be adapted for engagement with the inner sleeve 120. In one embodiment, the seal sleeve 130 includes a recess 131 for receiving a snap ring 132 from the inner sleeve 120. Similarly, the seal sleeve 130 may also be adapted for engagement with the housing 110. For example, the seal sleeve 130 may include a snap ring 133 for engagement with a recess 134 in the housing 110. It must be noted that the positions of the snap ring and recess may be reversed, for example, the recess 131 is on the inner sleeve 120 and the snap ring 132 is on the seal sleeve 130.

The seal sleeve 130 may be moved such that it straddles the port 115 and contacts the sealing members 117, 118 on the housing 110. The exterior surface of the seal sleeve 130 is adapted to engage the sealing members 117, 118. In one embodiment, the seal sleeve 130 may be adapted to engage the sealing members 117, 118 at different radial distances. As shown, a lower portion of the seal sleeve 130 may have a smaller outer diameter than an upper portion of the seal sleeve 130. In this respect, as the seal sleeve 130 is moved into closing position, the lower portion of the seal sleeve 130 is prevented from contacting the upper sealing member 117. However, the lower portion of the seal sleeve 130 can fully engage the lower sealing member 117 to close off fluid communication. Although the seal sleeve 130 is shown as having a step like outer configuration, the seal sleeve 130 may instead have a gradual incline outer configuration, or any other suitable configuration where the lower portion of the seal sleeve 130 will not engage the upper sealing member 118. In another embodiment, the seal sleeve 130 may have a constant outer diameter for engaging the sealing members 117, 118.

In operation, the ported tool 101 is run-in in the closed position as shown in FIGS. 2 and 2A. The ported tool 101 may be run-in with a casing string and used as a cementing tool. The port 115 is closed by the sealing members 121, 122 on the inner sleeve 120. The détente ring 127 is mated with the lower détente recess 151 to retain the inner sleeve 120 in place relative to the housing 110. The seal sleeve 130 is positioned away from the port 115 using, for example, a shear pin. Also shown in FIG. 2 is an actuation tool 140. The mating profile 144 of the actuation tool 140 is engaged with the lower profile 124 of the inner sleeve 120.

Figure 3:
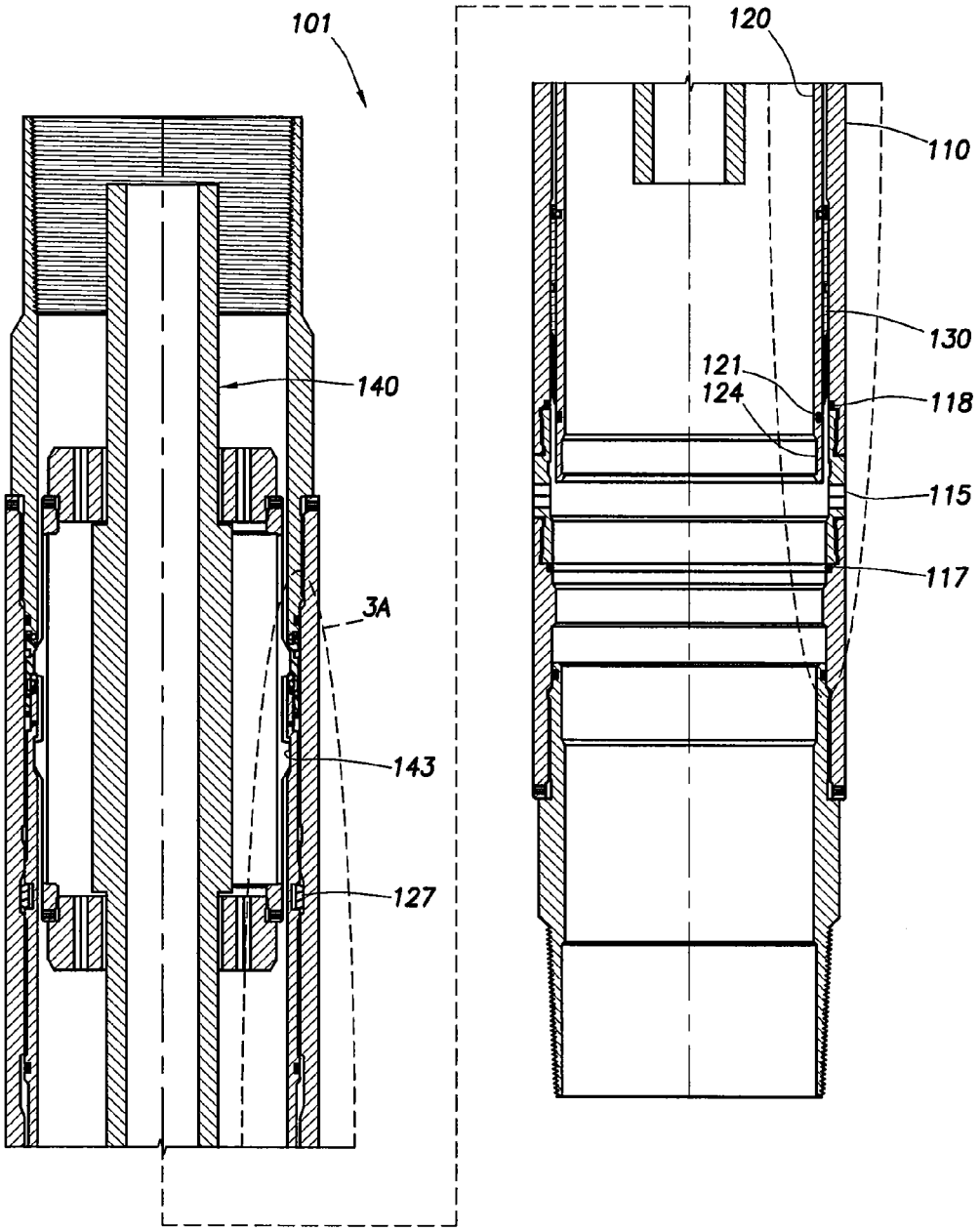
FIG. 3 is a cross-sectional view of the ported tool of FIG. 2 in the open position.
Figure 3A:
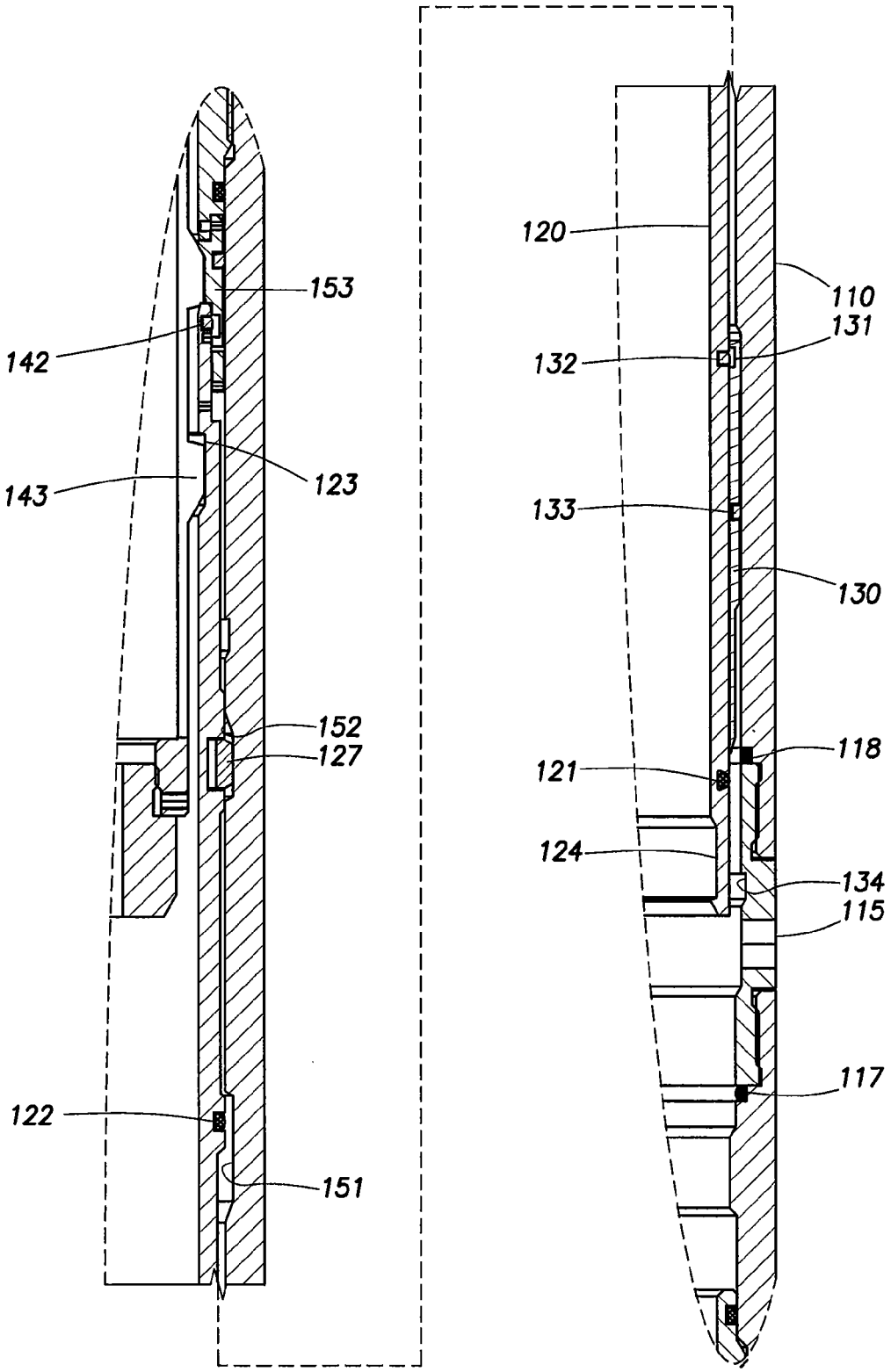
FIG. 3A is an enlarged partial view of FIG. 3.

To open the port 115, the actuation tool 140 is moved upward relative to the inner sleeve 120 to disengage the mating profile 144 from the respective lower profile 124 and to engage the mating profile 143 with the respective upper profile 123 of the inner sleeve 120. In one embodiment, the sleeve body 145 may flex inward to allow the mating profile 144 to disengage the lower profile 124 and to allow the actuation tool to move relative to the inner sleeve 120. When the mating profile 143 is adjacent the upper profile 123, the sleeve body 145 flexes outward such that the mating profile 143 engages the upper profile 123. After engagement of the profiles 123, 143, continued movement of the actuation tool 140 moves the inner sleeve 120 upward relative to the housing 110, thereby opening the port 115. FIGS. 3 and 3A show the port 115 in the open position. In this position, the détente ring 127 has moved from the lower détente recess 151 into the upper détente recess 152, which retains the inner sleeve 120 in the open position. Also, the snap ring 132 on the inner sleeve 120 is positioned adjacent to and engageable with the recess 131 in the seal sleeve 130. The ported tool 101 may include an optional locking mechanism for connecting the inner sleeve 120 to the housing 110. In one embodiment, the optional locking mechanism includes a locking member 142 on the inner sleeve 120 engaged with a locking sleeve 153 that is releasably attached to the housing 110.

Figure 4:
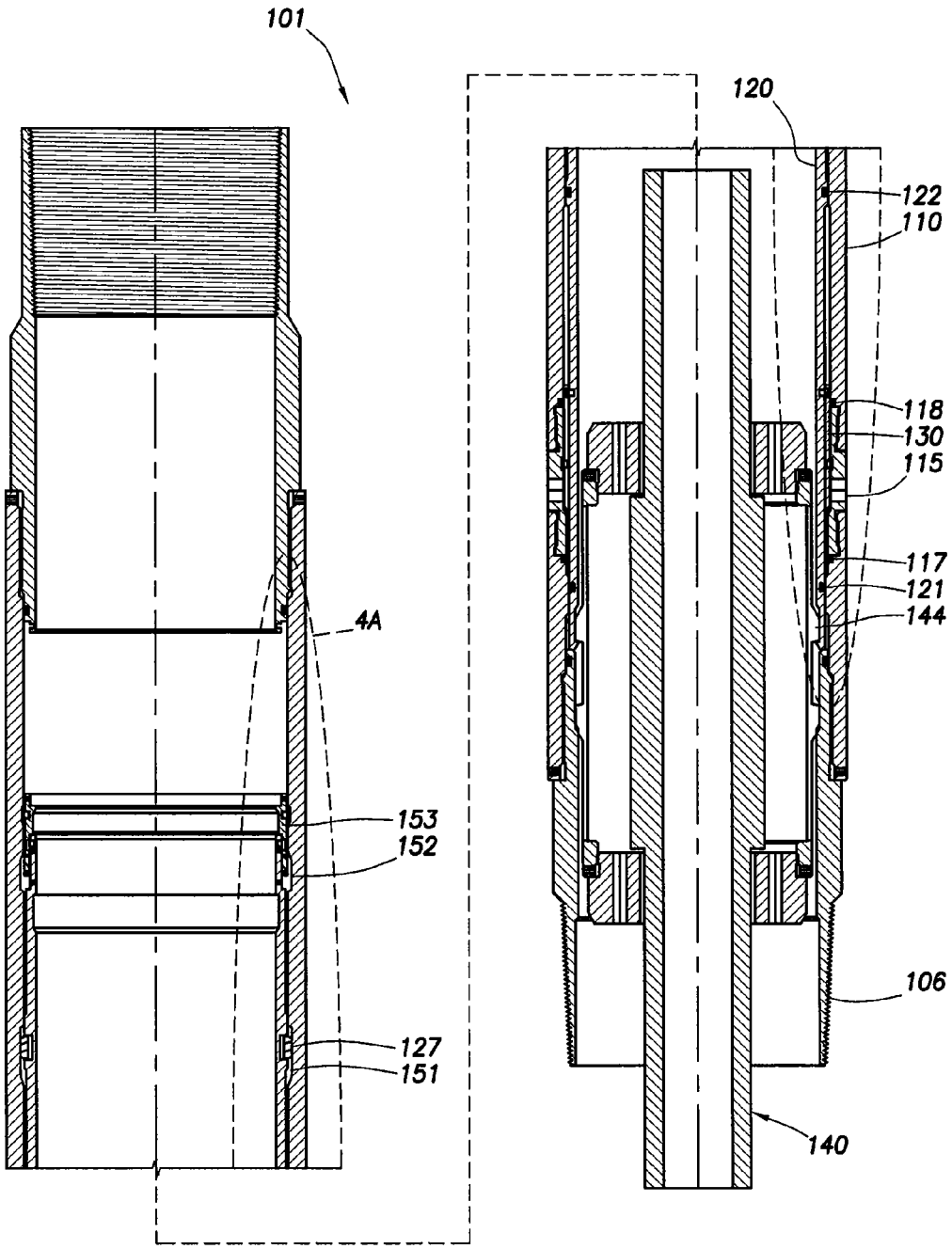
FIG. 4 is a cross-sectional view of the ported tool of FIG. 2 in the closed position.
Figure 4A:
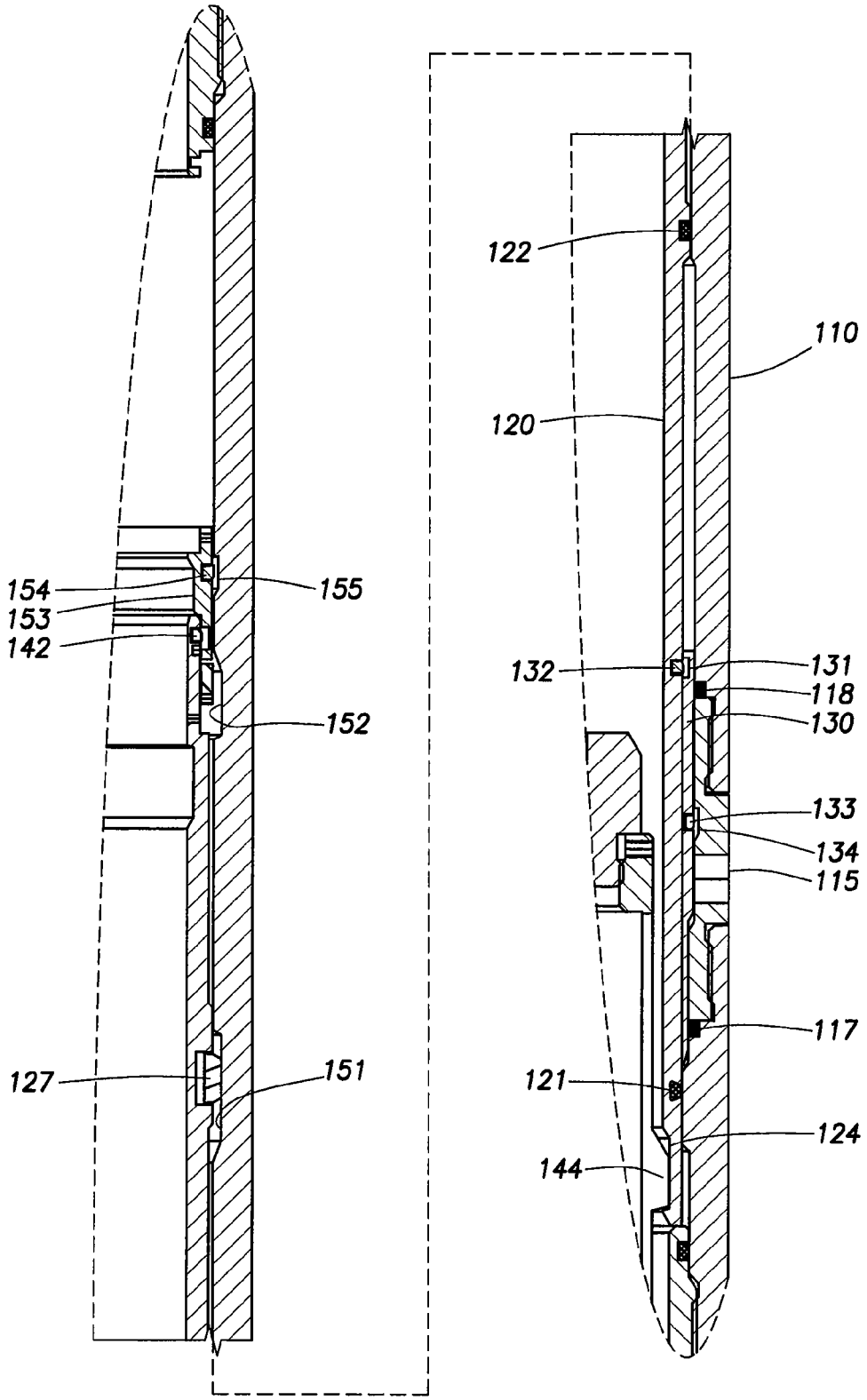
FIG. 4A is an enlarged partial view of FIG. 4.

To close the port 115, the actuation tool 140 is moved in the other direction to move the mating profile 144 into engagement with the lower profile 124 of the inner sleeve 120. A sufficient force is applied to release the détente ring 127 from the upper détente recess 152 and, if used, to release the seal sleeve from the shear pin and to release the locking sleeve 153 from the housing 110. The inner sleeve 120 is then caused to move back across the port 115. The seal sleeve 130 is moved with the inner sleeve 120 due to the snap ring connection 131, 132. The seal sleeve 130 is moved until the détente ring 127 engages the lower détente recess 151 and snap ring 133 engages the recess 134 in the housing 110, as shown in FIGS. 4 and 4A. As shown, the seal sleeve 130 has moved with the inner sleeve 120 and engaged with the sealing members 117, 118 on each side of the port 115, thereby closing off fluid communication. In this manner, a metal to metal seal may be provided to effect closing of the port 115. Also, the sealing members 121, 122 on the inner sleeve 120 optionally engage the housing 110 to provide a redundant seal. Further, a lock ring 154 on the optional locking sleeve 153 has engaged a recess 155 in the housing 110, thereby providing an additional lock to maintain the inner sleeve 120 in the closed position. Hence the seal sleeve 130 may be locked in the closed position using at least one of the snap ring 133 to the housing 110, the snap ring 132 to the inner sleeve 120, the détente ring 127 to the détente recess 51, the optional locking sleeve 153 to the housing 110, or combinations thereof.

Figure 5:
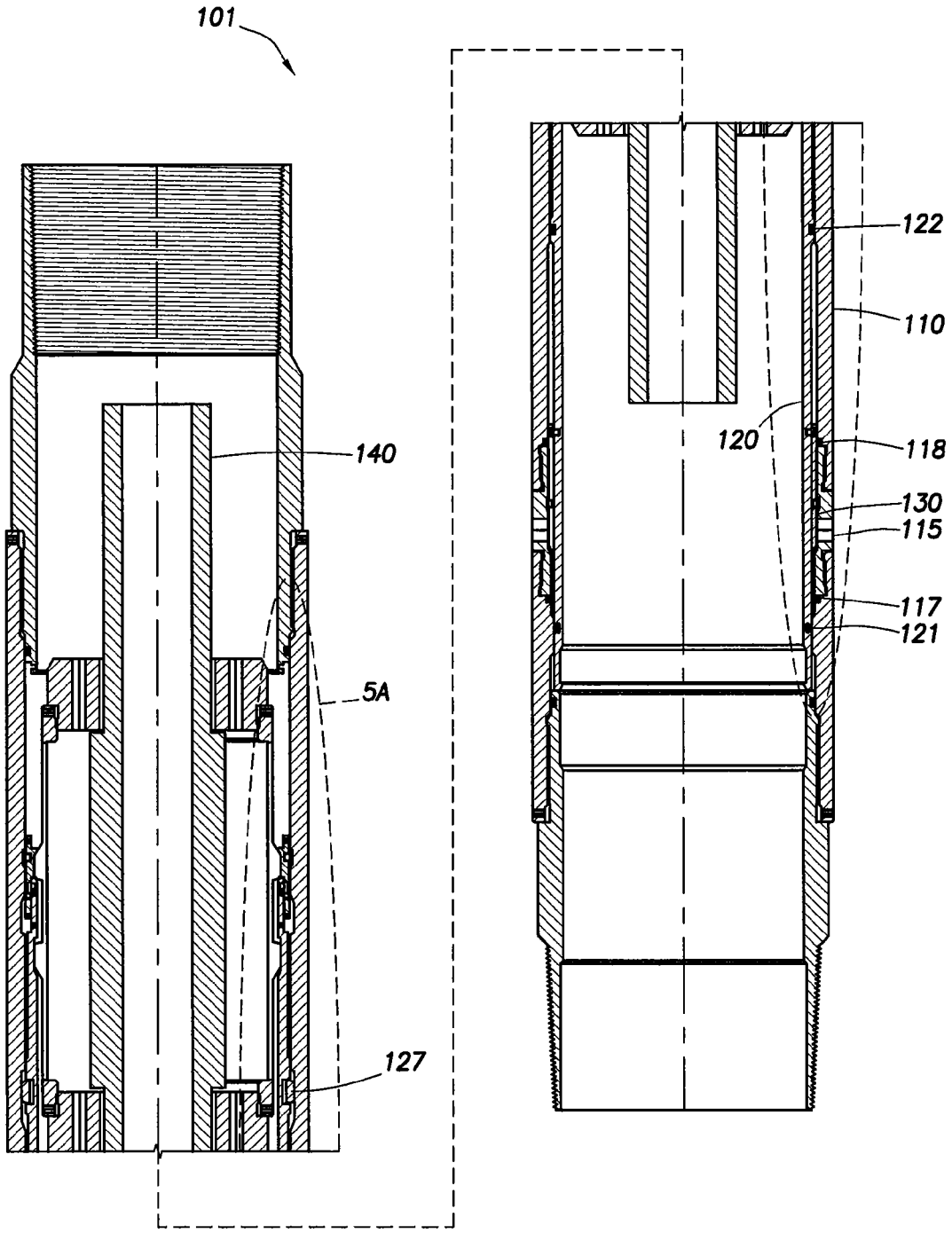
FIG. 5 is a cross-sectional view of the ported tool of FIG. 2 in the actuation tool retrieval position.
Figure 5A:
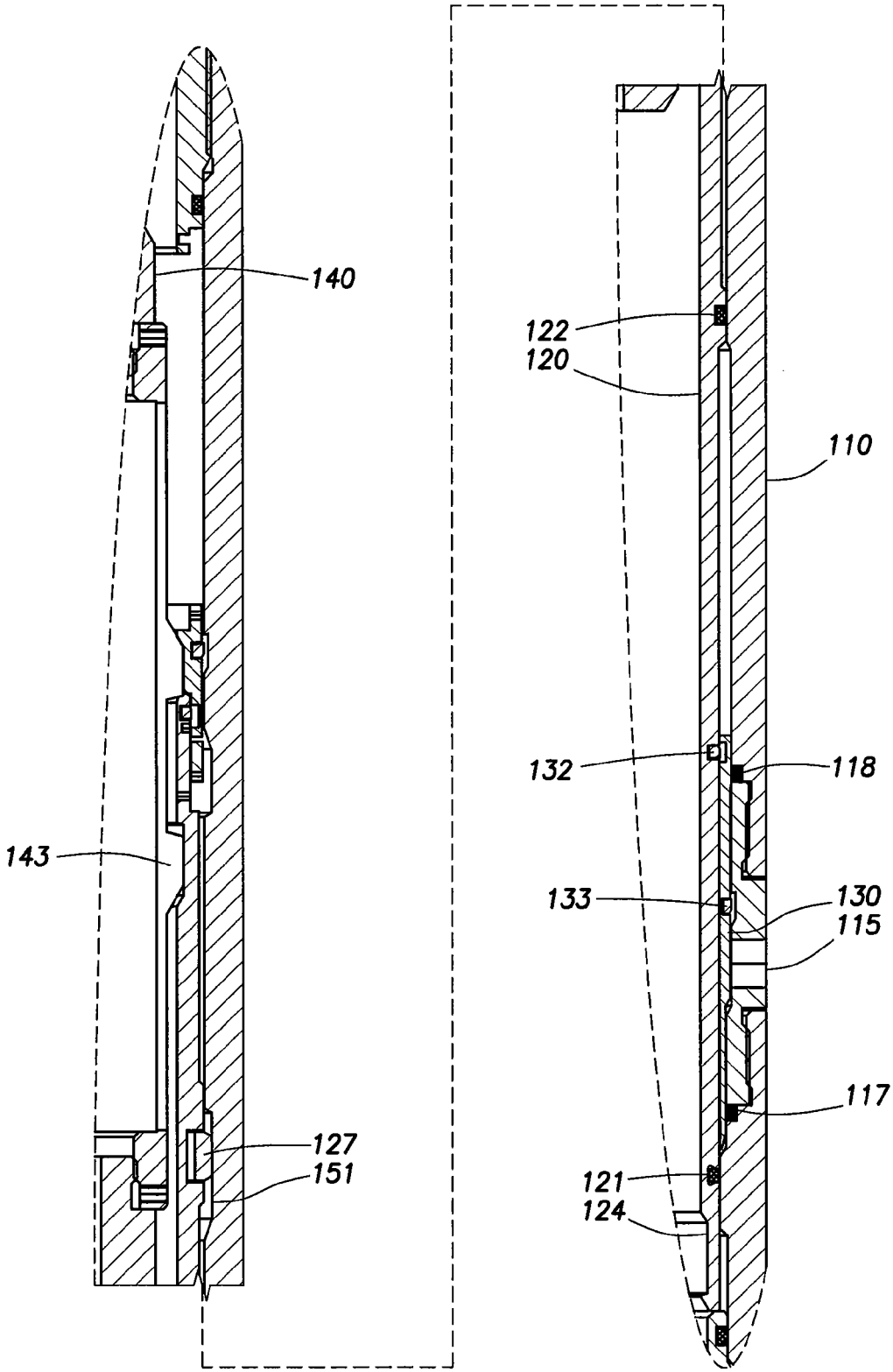
FIG. 5A is an enlarged partial view of FIG. 5.

To retrieve the actuation tool 140, the actuation tool 140 is moved to engage the upper profile 123, as shown in FIGS. 5 and 5A. Then a force sufficient to release the actuation tool 140 from the profile 123 but insufficient to release one of the connection mechanisms, such as the snap ring 133 to the housing 110 or the snap ring 132 to the inner sleeve 120, is applied to release the actuation tool 140 for removal.

In another embodiment, the ported tool may be adapted for multiple operations. For example, during opening, inner sleeve 120 may move sufficiently to open the port 115, but not allow the snap ring 132 to engage the recess on the seal sleeve 130. In this respect, the inner sleeve 120 may be repeatedly opened and closed.

In another embodiment, the seal sleeve 130 may be adapted to increase the sealing effect. For example, the seal sleeve 130 may be designed to be deformable in response to pressure. In the closed position, pressure from the interior of the housing may deform the seal sleeve against the housing, thereby increasing the sealing effect.

It is contemplated that other suitable forms of connection devices may be used to interconnect the sleeves to each other or to the housing. Exemplary connection devices include collets, profile dogs, ratchet mechanism, or other suitable devices known to a person of ordinary skill. For example, a ratchet mechanism may be provided between the inner sleeve and the seal sleeve. In one embodiment, the inner sleeve may include a ratchet ring which moves along a teethed outer surface of the seal sleeve. The ratchet allows the inner sleeve to move relative to the seal sleeve when moved in one direction, and causes the sleeves to move together when moved in the other direction. In operation, the ratchet allows the inner sleeve to move relative to the seal sleeve to open the port, and cause the sleeves to move together to close the port. After closing, a second ratchet mechanism between the seal sleeve and the housing may prevent the seal sleeve from opening. During retrieval, the ratchet mechanisms prevent the sleeves from opening while a force is applied to separate the actuation tool from the inner sleeve.

In one embodiment, the ported tool having the dual sleeve sealing mechanism may be used with a casing string having an optional packer for a cementing operation. FIGS. 6A-6F show a cementing operation in sequential steps using a ported sub 804 such as the ported tool 101 described with respect to FIG. 2. In FIG. 6A, the casing string 802 is disposed in a borehole 801, which may be cased or uncased. The casing string 802 includes a packer 803 and the ported sub 804. The port of the ported sub 804 is in the closed position. An annulus 808 exists between the casing string 802 and the borehole 801. During first stage cementing, cement is supplied through the bottom of the casing string 802 and up the annulus 808. As shown in FIG. 6B, the cement 805 during the first stage is at a height just below the packer 803. However, it must be noted that the cement may be supplied to a height at or above the port sub 804.

Figure 6C:
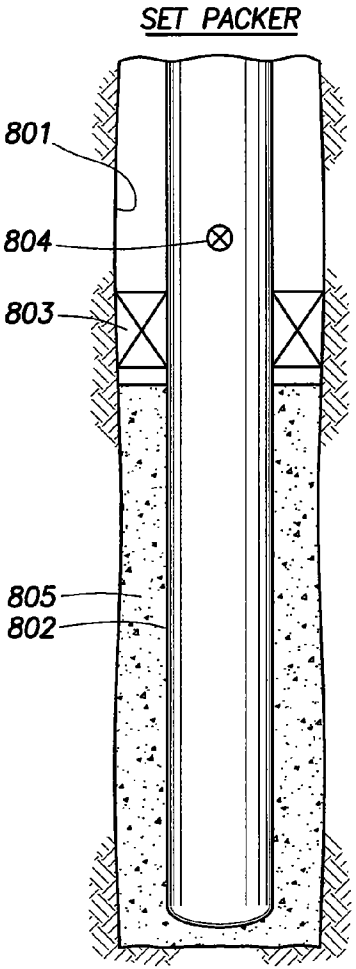
FIGS. 6A-6F show an exemplary cementing operation using an embodiment of the ported tool in sequential steps.
Figure 6B:
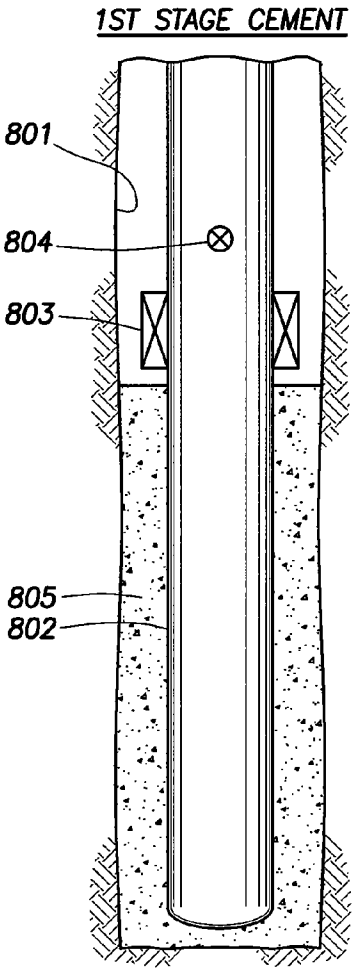
Figure 6A:
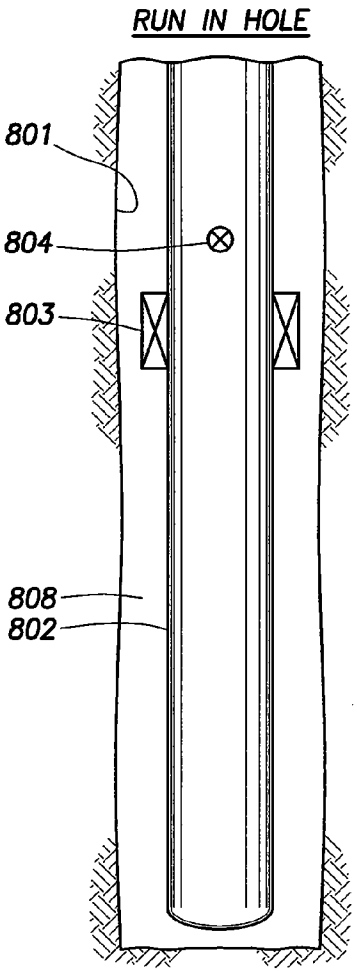
Figure 6F:
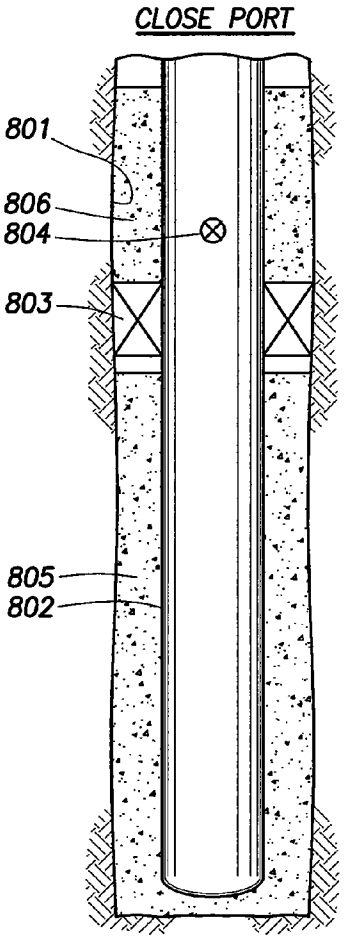
Figure 6E:
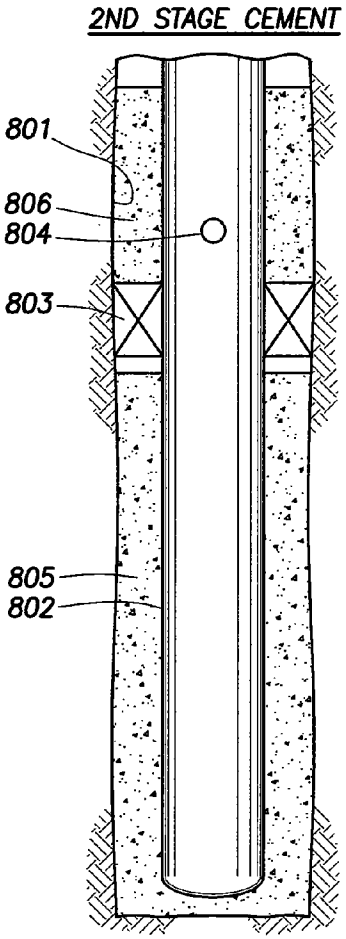
Figure 6D:
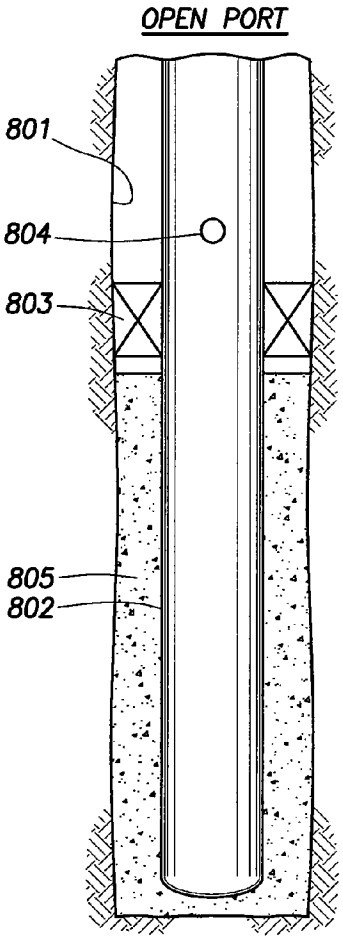

After first stage cementing, the packer 803 is optionally set to form a seal in the annulus 808, as shown in FIG. 6C. Thereafter, the port in the ported sub 804 is opened, as shown in FIG. 6D. For example, the actuation tool may engage the inner sleeve of the ported sub 804 and move the inner sleeve to open the port. Cement is then supplied through the port and into the annulus 808. FIG. 6E shows the borehole 801 with the second stage cement 806. After a desired amount of cement has been supplied, the port of the ported sub 804 is closed by moving the inner sleeve and the attached seal sleeve across the port.

In one embodiment, the casing string 802 may have multiple ported subs 804 positioned along the casing string 802. In this respect, several stages of cementing may be performed.

It must be noted that while embodiments of the present invention is described and shown as moving the inner sleeve up to open and down to close, it is contemplated that the apparatus may be modified to perform the process in reversed, such as down to open and up to close.

While the foregoing is directed to embodiments of the present invention, other and further embodiments of the invention may be devised without departing from the basic scope thereof, and the scope thereof is determined by the claims that follow.

The invention claimed is:

1. An apparatus for providing fluid communication in a wellbore, comprising:

a housing having a port;

an inner sleeve that is movable in a first direction to open the port and movable in a second direction to seal the port, wherein the second direction is opposite the first direction;

a seal sleeve adapted to seal the port, wherein the seal sleeve is disposed between the inner sleeve and the housing and is configured to selectively engage the housing to form a metal to metal seal; and a locking member for selectively connecting the inner sleeve to the seal sleeve when the port is open, whereby the seal sleeve is movable with the inner sleeve to seal the port.

2. The apparatus of claim 1, wherein the port is sealed using the metal to metal seal.

3. The apparatus of claim 1, further comprising a sealing member disposed in the housing for contacting the seal sleeve.

4. The apparatus of claim 3, wherein the sealing member is non-elastomeric.

5. The apparatus of claim 4, wherein the sealing member is metal.

6. The apparatus of claim 5, wherein the seal sleeve includes a metal surface for contacting the sealing member.

7. The apparatus of claim 6, wherein the seal sleeve engages the sealing member at a first radial distance and a second sealing member at a second and decreased radial distances.

8. The apparatus of claim 7, wherein the seal sleeve is tapered at one end.

9. The apparatus of claim 3, wherein the inner sleeve includes a second sealing member for sealing contact with the housing.

10. The apparatus of claim 1, wherein the inner sleeve includes a sealing member for sealing contact with the housing.

11. The apparatus of claim 1, wherein the locking member comprises a snap ring.

12. The apparatus of claim 1, further comprising a second locking member for connecting the seal sleeve to the housing.

13. The apparatus of claim 1, wherein the inner sleeve is selectively movable relative to the seal sleeve.

14. A method of controlling fluid communication through a port of a ported tool disposed in a wellbore, comprising:

providing one or more sealing members adjacent to each side of the port;

moving an inner sleeve in a first direction to open the port;

supplying fluid through the port;

attaching the inner sleeve to a seal sleeve for movement therewith after opening the port; and moving the seal sleeve and the inner sleeve in a second direction opposite the first direction from one side of the port into contact with the one or more sealing members on each side of the port, thereby closing off the port.

15. The method of claim 14, further comprising securing the seal sleeve to a wall of the ported tool.

16. The method of claim 14, wherein engaging the seal sleeve to the one or more sealing members comprises deforming the one or more sealing members.

17. The method of claim 14, wherein the one or more sealing members comprise a non-elastomeric seal.

18. The method of claim 17, wherein the one or more sealing members comprise a metal.

19. The method of claim 17, wherein the seal sleeve comprises a non-elastomeric surface for contacting the one or more sealing members.

20. The method of claim 14, wherein the seal sleeve is tapered at one end.

21. The method of claim 14, wherein the inner sleeve is moved in a first direction to open the port, and the seal sleeve is moved in a second direction to close the port.

22. A method of cementing a wellbore, comprising:

positioning a casing string in the wellbore, wherein the casing string includes a ported tool having a port in a housing;

providing a seal sleeve having a sealing portion disengaged from the housing;

supplying cement through the bottom of the casing string;

opening the port by moving an inner sleeve in a first direction relative to the seal sleeve;

supplying more cement through the port; and moving the inner sleeve and the seal sleeve in a second direction opposite the first direction across the port, wherein the sealing portion engages the housing to form a metal to metal seal to close the port.

23. The method of claim 22, further comprising connecting the inner sleeve to the seal sleeve for simultaneous movement after opening the port.

24. The method of claim 23, further comprising connecting the seal sleeve to the housing containing the port after closing.

25. The method of claim 24, further comprising activating a packer prior to supplying more cement through the port.

26. The method of claim 24, further comprising engaging the seal sleeve to a plurality of sealing members on the housing.

27. The method of claim 26, further comprising providing the inner sleeve with a plurality of sealing members for sealing contact with the housing.

28. The method of claim 22, wherein the inner sleeve is moved in a first direction to open the port, and the seal sleeve is moved in a second direction to close the port.

29. An apparatus for providing fluid communication in a wellbore, comprising:

a housing having a port;

an inner sleeve adapted to seal the port, the inner sleeve movable in a first direction to open the port, and movable in a second direction opposite the first direction to close the port; and a seal sleeve adapted to seal the port, wherein the seal sleeve is disposed between the inner sleeve and the housing and is movably disposed on only one side of the port when the port is open, and wherein the seal sleeve is selectively attachable with the inner sleeve in operation for moving with the inner sleeve to close the port.

30. The apparatus of claim 29, wherein the inner sleeve has:

a first position where the inner sleeve is movable independently of the seal sleeve; and a second position where the inner sleeve is movable with the seal sleeve.

31. The apparatus of claim 30, wherein the port is sealed using a metal to metal seal.

32. The apparatus of claim 30, further comprising a sealing member disposed in the housing for contacting the seal sleeve.

33. The apparatus of claim 32, wherein the sealing member is non-elastomeric.

34. The apparatus of claim 33, wherein the sealing member is metal.

35. The apparatus of claim 34, wherein the seal sleeve includes a metal surface for contacting the sealing member.

36. The apparatus of claim 35, wherein the seal sleeve engages two sealing members at a first radial distance and at a second and decreased radial distance.

37. The apparatus of claim 32, wherein the inner sleeve includes a second sealing member for sealing contact with the housing.

38. The apparatus of claims 30, wherein the inner sleeve includes a sealing member for sealing contact with the housing.

39. The apparatus of claim 29, further comprising a connection member for connecting the inner sleeve to the seal sleeve.

40. The apparatus of claim 39, further comprising a second locking member for connecting the seal sleeve to the housing.

41. The apparatus of claim 39, wherein the connection member comprises a snap ring.

* * * * *